US011346189B2

(12) United States Patent
Yee et al.

(10) Patent No.: US 11,346,189 B2
(45) Date of Patent: May 31, 2022

(54) METHOD AND APPARATUS FOR EXPANDING WELLBORE CASING

(71) Applicant: Enventure Global Technology, Inc., Houston, TX (US)

(72) Inventors: Chee Kong Yee, Katy, TX (US); Frederick Cornell Bennett, Houston, TX (US); Eric J. Connor, Katy, TX (US); Matthew Mark Godfrey, Katy, TX (US)

(73) Assignee: Enventure Global Technology Inc.

( * ) Notice: Subject to any disclaimer, the term of this patent is extended or adjusted under 35 U.S.C. 154(b) by 68 days.

(21) Appl. No.: 16/768,853

(22) PCT Filed: Nov. 15, 2018

(86) PCT No.: PCT/US2018/061303
§ 371 (c)(1),
(2) Date: Jun. 1, 2020

(87) PCT Pub. No.: WO2019/108405
PCT Pub. Date: Jun. 6, 2019

(65) Prior Publication Data

US 2021/0189843 A1 Jun. 24, 2021

Related U.S. Application Data

(60) Provisional application No. 62/593,518, filed on Dec. 1, 2017.

(51) Int. Cl.
*E21B 43/10* (2006.01)

(52) U.S. Cl.
CPC ..... *E21B 43/105* (2013.01); *E21B 43/106* (2013.01)

(58) Field of Classification Search
CPC ..... E21B 43/105; E21B 43/106
See application file for complete search history.

(56) References Cited

U.S. PATENT DOCUMENTS 3,011,555 A * 12/1961 Clark, Jr. ..... E21B 23/06 166/122
9,085,967 B2 7/2015 Bennett
(Continued)

FOREIGN PATENT DOCUMENTS

WO 2017-001391 A1 1/2017

OTHER PUBLICATIONS

Written Opinion of the International Searching Authority in international application PCT/US2018/061303 dated Jan. 28, 2019, 7 pages.

(Continued)

*Primary Examiner* — D. Andrews
(74) *Attorney, Agent, or Firm* — Jonathan Pierce; Pierre Campanac; Porter Hedges LLP

(57) ABSTRACT

A tool for expanding a liner in a wellbore includes a cone assembly that is moveable between a retracted position and an extended position. The tool also includes a jack assembly that is operable by fluid pressure to move the cone assembly from the retracted position to the extended position. The fluid pressure is also applied to expansion cup seals to generate axial load that urges the cone assembly to move through the expandable liner and radially expand of the expandable liner. A latch assembly axially fixes the liner while the cone assembly moves to the extended position. Once the cone assembly is fully moved to the extended position, the latch assembly releases the liner, allowing the cone assembly to move through the liner and radially expand the liner.

25 Claims, 5 Drawing Sheets

(56) References Cited

U.S. PATENT DOCUMENTS

| | | | | |
|---|---|---|---|---|
| 2005/0056433 | A1* | 3/2005 | Ring | E21B 43/105 166/384 |
| 2006/0102360 | A1 | 5/2006 | Brisco | |
| 2009/0065196 | A1 | 3/2009 | Holland | |
| 2011/0011578 | A1 | 1/2011 | Noel | |
| 2012/0152565 | A1 | 6/2012 | Bennett | |
| 2013/0333873 | A1 | 12/2013 | Giroux | |
| 2014/0027118 | A1 | 1/2014 | Delange | |
| 2015/0013971 | A1 | 1/2015 | Foubister | |
| 2015/0315882 | A1 | 11/2015 | Bennett | |
| 2017/0284176 | A1 | 10/2017 | Bennett | |
| 2017/0342811 | A1 | 11/2017 | Braddick | |
| 2018/0119527 | A1* | 5/2018 | Jabs | E21B 43/105 |

OTHER PUBLICATIONS

UKIPO, Examination report issued in corresponding application serial No. GB 2008134.5 dated Nov. 22, 2021; 4 pages.

* cited by examiner

METHOD AND APPARATUS FOR EXPANDING WELLBORE CASING

BACKGROUND

This disclosure relates generally to methods and apparatus for expanding wellbore tubular members, such as casing, liners, and the like. More specifically, this disclosure relates to methods and apparatus for expanding a first section of expandable tubular to an inside diameter that allows a second section of expandable tubular and expansion assembly to pass through the previously expanded section and then be expanded to the same inside diameter.

In the oil and gas industry, expandable tubing is often used for casing, liners and the like. To create a casing, for example, a tubular member is installed in a wellbore and subsequently expanded by displacing an expansion cone through the tubular member. The expansion cone may be pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial force, the tubular member plastically deforms, thereby permanently increasing both its inner and outer diameters. In other words, the tubular member expands radially. Expandable tubulars may also be used to repair, seal, or remediate existing casing that has been perforated, parted, corroded, or otherwise damaged since installation.

In certain application, it may be desirable to install a series of expanded tubular sections having the same inside diameter. Many prior art expansion systems are sized so that the maximum diameter of the expansion system in a running configuration, together with a new tubular to be expanded, is too large to pass through a previously expanded tubular section and a smaller diameter system has to be used.

Thus, there is a continuing need in the art for methods and apparatus for expansion systems and methods that overcome these and other limitations of the prior art.

SUMMARY

The disclosure describes a system for expanding an expandable liner.

The expandable system may comprise a cone assembly, which may be disposed within the expandable liner. The cone assembly may be moveable between a retracted position and an extended position. Axial movement of the cone assembly set in the extended position through the expandable liner may radially expand the expandable liner.

The expandable system may comprise a jack assembly, which may be disposed within the expandable liner and may be coupled to the cone assembly. The jack assembly may be operable to move the cone assembly from the retracted position to the extended position. The jack assembly may comprise an upper coupling operable to lock the jack assembly until a fluid pumped into the expandable system reaches a predetermined pressure. For example, the upper coupling may comprise a piston sleeve operable to move from a first position urging dogs toward the jack assembly and a second position permitting the dogs to move radially outward, and one or more pins configured to shear upon the fluid applying the predetermined pressure on the piston sleeve.

The expandable system may comprise a latch assembly, which may be disposed within the expandable liner and may be coupled to the jack assembly and the cone assembly. The latch assembly may be operable to releasably couple the jack assembly and the cone assembly to the expandable liner. For example, the latch assembly may comprise one or more latch dogs operable to move radially inward and disengage one or more corresponding receptacles formed on the inner surface of the expandable liner. The latch assembly may be operable to release the jack assembly and the cone assembly from the expandable liner upon the cone assembly reaching the extended position. For example, the latch assembly may comprise one or more latch dogs operable to engage one or more corresponding receptacles formed on the inner surface of the expandable liner; the jack assembly may further comprise a release groove that registers with the one or more latch dogs upon the cone assembly reaching the extended position; and, the one or more latch dogs may be operable to move radially inward and disengage the expandable liner upon the release groove registering with the one or more latch dogs. The jack assembly may further be operable to retain the cone assembly in the extended position. For example, the one or more latch dogs may be operable to move radially inward and engage the release groove upon the release groove registering with the one or more latch dogs. Alternately, some other means may be used to retain the cone assembly in the extended position, such as a ratcheting lock ring disposed between a body and a mandrel of the jack assembly.

The expandable system may comprise expansion cup seals, which may be coupled to the jack assembly. The expansion cup seals may be operable to move the cone assembly set in the extended position through the expandable liner and cause radial expansion of the expandable liner.

The disclosure also describes a method for expanding a liner.

The method may involve coupling an expansion tool to an expandable liner with a latch assembly. The expansion tool may include a cone assembly, a jack assembly, and the latch assembly.

The method may involve disposing the expansion tool and expandable liner into a wellbore.

The method may involve locking the jack assembly until a fluid pumped into the expandable system reaches a predetermined pressure. The method may further involve moving the cone assembly from a retracted position to an extended position using the jack assembly. The latch assembly may maintain the coupling between the expansion assembly and the expandable liner while the cone assembly is moving from the retracted position to the extended position.

The method may involve releasing the latch assembly so as to decouple the expansion tool from the expandable liner once the cone assembly is fully moved to the extended position. The method may further involve retaining the cone assembly in the extended position once the cone assembly is fully moved to the extended position.

The method may involve moving the cone assembly through the expandable liner without using the jack assembly, wherein moving the cone assembly radially expands the expandable liner. For example, the moving of the cone assembly through the expandable liner may be performed by applying fluid pressure on expansion cup seals coupled to the jack assembly.

BRIEF DESCRIPTION OF THE DRAWINGS

For a more detailed description of the embodiments of the present disclosure, reference will now be made to the accompanying drawings, wherein.

DETAILED DESCRIPTION

Figure 1A:
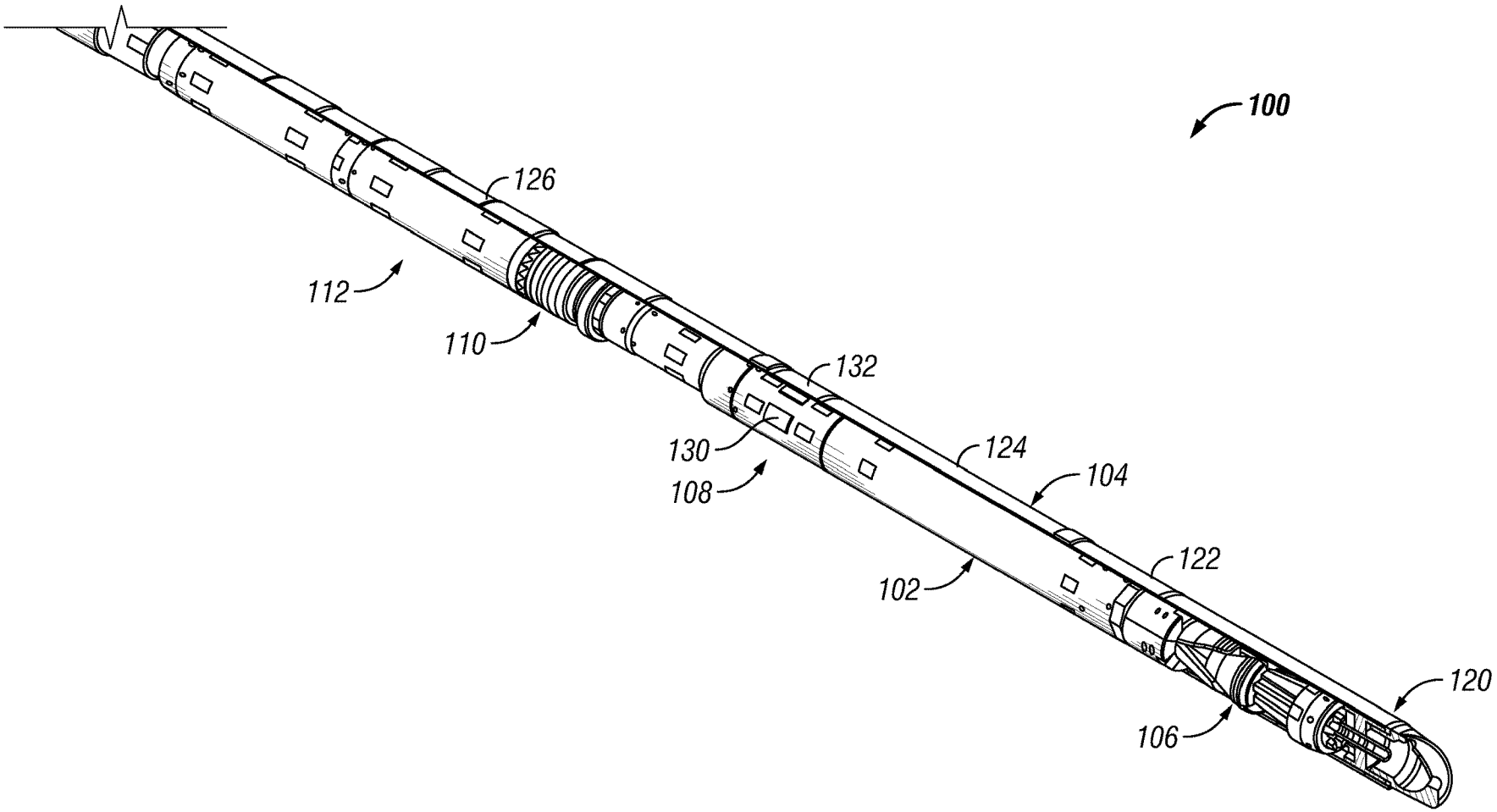
FIGS. 1A-1B illustrate one embodiment of an expansion assembly including an expandable casing and an expansion assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 1B:
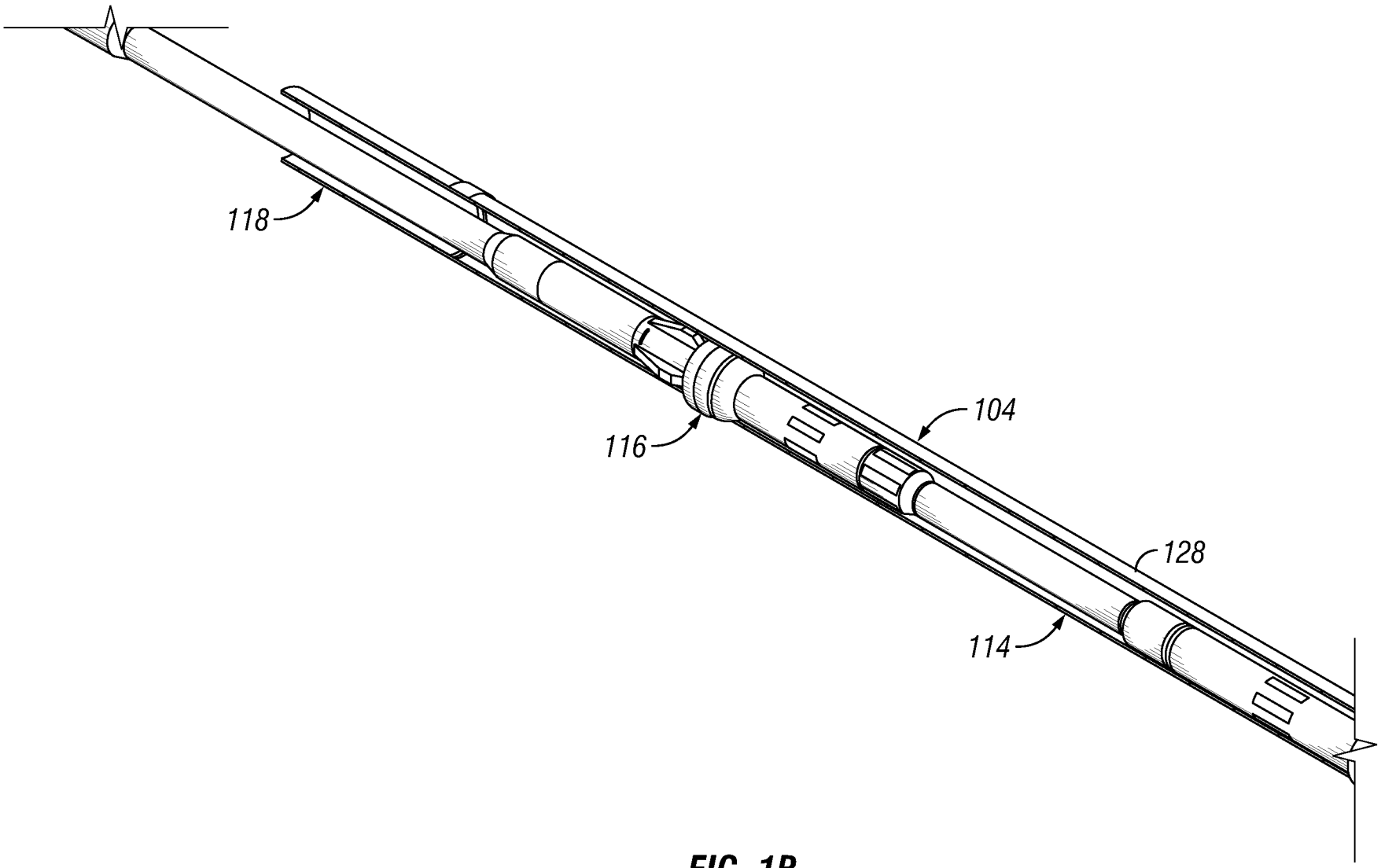

Referring initially to FIGS. 1A and 1B, an expandable system 100 includes an expansion assembly 102 and an expandable liner 104 (shown in cutaway view). The expansion assembly 102 includes a cone assembly 106, latch assembly 108, expansion cup seals 110, jack assembly 112, safety sub 114, and debris catcher 116, and the expansion assembly 102 is connected to running string 118. The expansion assembly 102 is disposed within the expandable liner 104, which includes a shoe assembly 120, lower casing 122, latch casing 124, anchor casing 126, and upper casing 128. In certain embodiments, each of the lower casing 122, latch casing 124, anchor casing 126, and upper casing 128 are formed from expandable tubulars connected to one another by a series of expandable threaded connections.

In the running configuration as shown in FIGS. 1A and 1B, the expansion assembly 102 is disposed within the expandable liner 104 such that the cone assembly 106 is engaged with the shoe assembly 120. The latch assembly 108 includes one or more latch dogs 130 that protrude from the outer surface of the latch assembly so as to engage a corresponding receptacle 132 formed on the inner surface of the latch casing 124. In certain embodiments, the latch dogs 130 may include a threaded or grooved outer surface that engages with corresponding threads or grooves that form the receptacle 132. The engagement of the dogs 130 and receptacle 132 axially couples the expansion assembly 102 to the expandable liner 104 as the expandable system 100 is run into a wellbore.

Figures 2A, 2B, 2C, 2D:
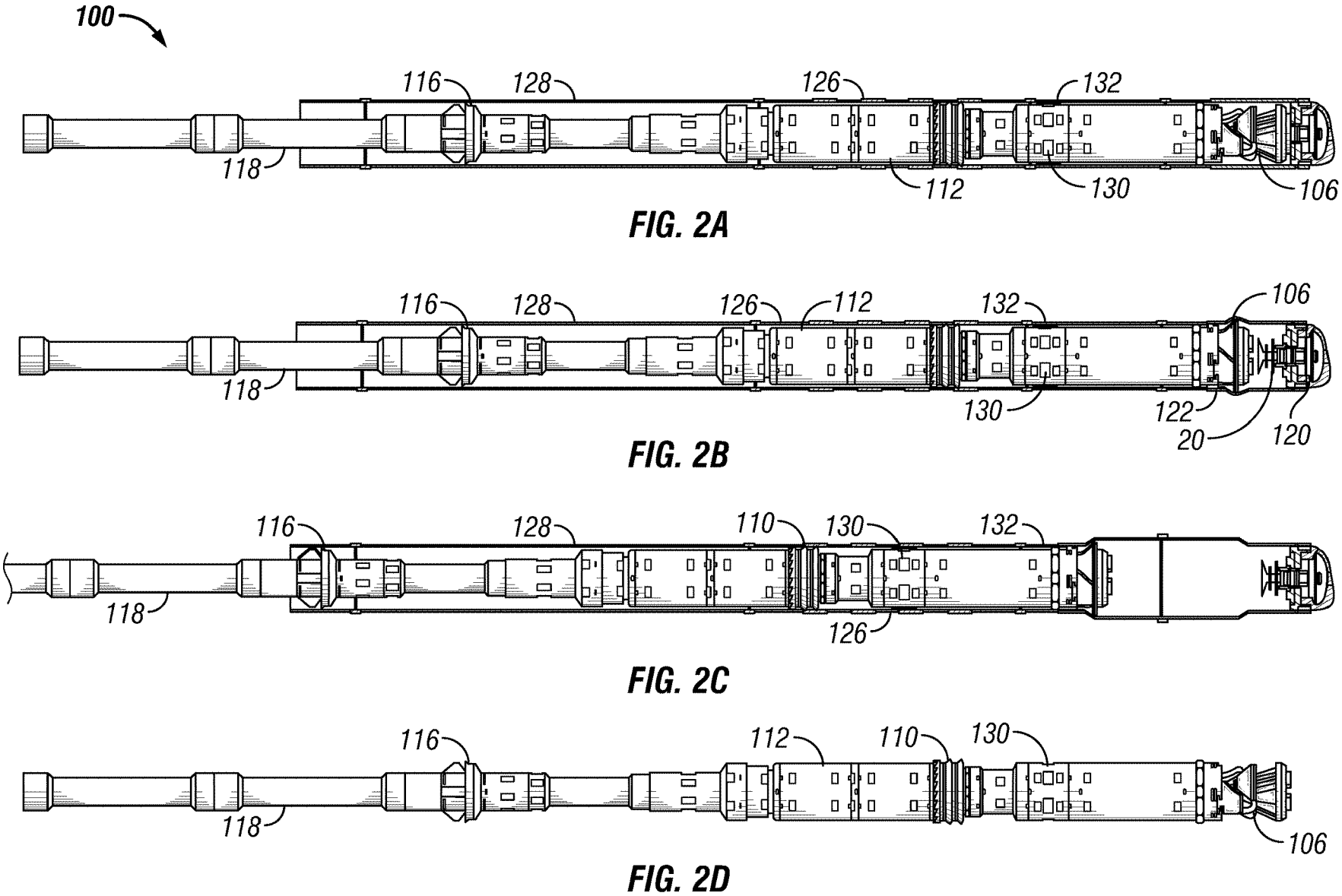
FIGS. 2A-2D illustrate the installation of an expandable using the expansion assembly of FIGS. 1A-1B.

Referring now to FIGS. 2A-2D, the operation of the expandable system 100 shown in FIGS. 1A and 1B is illustrated. In particular, FIG. 2A shows the expansion assembly 102 in a running configuration where dogs 130 are engaged with receptacle 132 and cone assembly 106 is in a collapsed position. To activate the expansion assembly 102, a dart 20 is dropped from the surface, through the running string 118 and expansion assembly 102 to engage the shoe assembly 120. The dart 20 blocks the flow of fluid through the shoe assembly 120 so that pressurized fluid is contained within the expandable liner 104 and within the expansion assembly 102.

Continued supply of pressurized fluid to the expansion assembly 102 activates jack assembly 112. The activated jack assembly 112 causes the cone assembly 106 to shift from a collapsed position to an extended position as is shown in FIG. 2B. The engagement of the dogs 130 and receptacle 132 maintain the position of the expansion assembly 102 within the expandable liner 104 as the jack assembly 112 actuates to shift the cone assembly 106. As the cone assembly 106 is moved to the extended position, the cone assembly radially expands the lower casing 122.

As shown in FIG. 2C, once cone assembly 106 is fully in the extended position, dogs 130 release from receptacle 132 and the expansion assembly 102 is free to move within the expandable liner 104. Thus, continued supply of pressurized fluid to the expansion assembly 102 creates a differential pressure across expansion cup seals 110 sufficient to axially move the expansion assembly through and radially expand the expandable liner 104. The expansion assembly 102 can then be removed from the expandable liner 104 as shown in FIG. 2D.

Figure 3A:
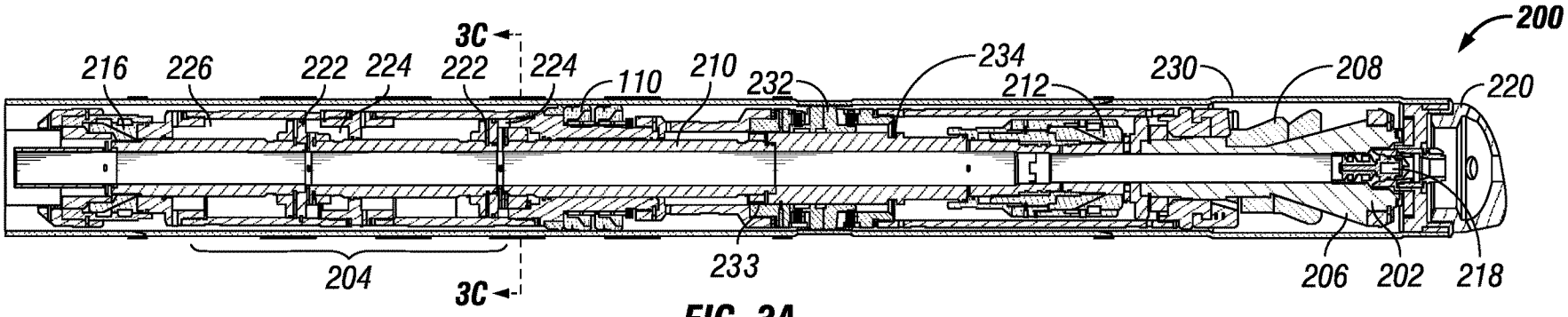
FIGS. 3A-3C illustrate one embodiment of an expansion cone moving from a retracted position to an extended position.
Figure 3C:
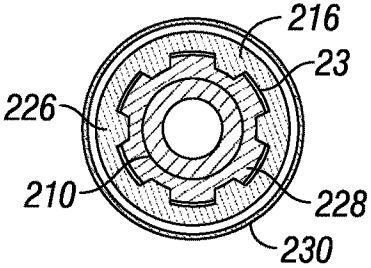
Figure 3B:
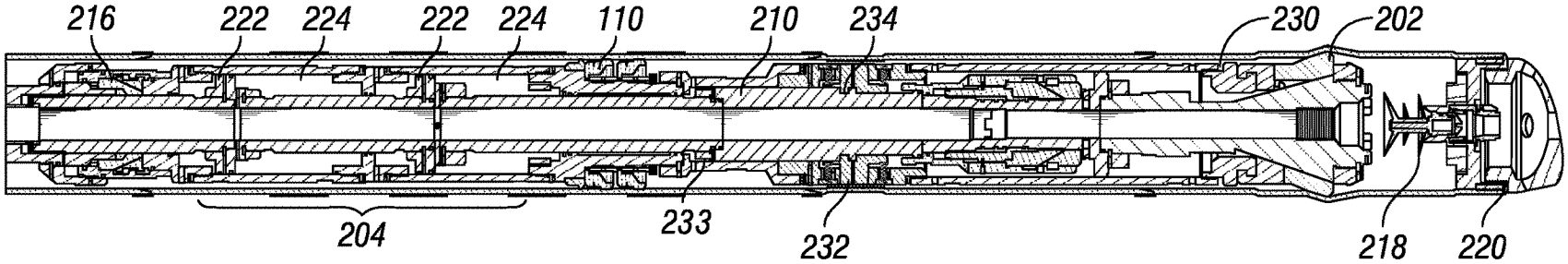

FIGS. 3A and 3B show a sectional view of one embodiment of an expandable system 200 so as to illustrate the shifting of a cone assembly 202 from a collapsed position (FIG. 3A) to an extended position (FIG. 3B) using a jack assembly 204. Cone assembly 202 includes a tapered mandrel 206 and a plurality of cone segments 208. The tapered mandrel 206 is coupled to a jack mandrel 210 via lower coupling 212. Pistons 222 are coupled to the jack mandrel 210 and disposed within pressure chambers 224 formed by jack body 226. In the running position shown in FIG. 3A, the jack mandrel 210 is coupled to jack body 226 by upper coupling 216. In certain embodiments, jack mandrel 210 is rotationally secured to the jack body 226 by splines 228 and grooves 23 as shown in FIG. 3C or other features as are known in the art.

To actuate the cone assembly 202, a dart 218 (or other sealing member) is pumped through the jack mandrel 210 and lands in shoe assembly 220 so as to prevent fluid from passing from the jack mandrel through the shoe assembly. Once the pressure reaches a predetermined level, upper coupling 216 releases and the jack mandrel 210 is free to move axially relative to the jack body 226. For example, upper coupling 216 may comprise a piston sleeve, dogs engaged with the jack mandrel 210, and one or more shear pins. One side of the piston sleeve may be in pressure communication with the bore of the jack mandrel 210 via passageways provided across a wall of the jack mandrel 210 and across a wall of the jack body 226, and the other side of the piston sleeve may be in pressure communication with the wellbore. Once the fluid pressure reaches a sufficient level to shear the pins, the piston sleeve that is urging the dogs in a groove in the jack mandrel 210 moves and permits the dogs to move radially outward, and the dogs release the jack mandrel 210.

Continued pumping of fluid into jack mandrel 210 increases the pressure within pressure chambers 224, which act against pistons 222 to apply an axial load to the jack mandrel 210. For example, the pressure chambers 224 that are located on one side of the pistons 222 (e.g., the right side as illustrated in FIGS. 3A and 3B) may be in pressure communication with the bore of the jack mandrel 210 via passageways provided across a wall of the jack mandrel 210. The pressure chambers that are located on the other side of the pistons 222 (e.g., the left side as illustrated in FIGS. 3A and 3B) may be in pressure communication with the wellbore via passageways provided across a wall of the jack body 226. As pumping fluid into the jack mandrel 210 continues, the jack mandrel will move axially relative to jack body 226 and the tapered mandrel 206 will move axially relative to the cone segments 208 and move the cone segments outward to radially expand tubular member 230. During the initial movement of the jack mandrel 210, tubular member 230 is axially fixed to the jack body 226 via dogs 232.

Once the cone segments 208 are in their fully extended position, as shown in FIG. 3B, a release groove 234 on jack mandrel 210 engage dogs 232 and allows the dogs to move radially inward and disengage the tubular member 230. The engagement of dogs 232 and release groove 234 also acts to again axially couple the jack mandrel 210 to the jack body 226. Alternately or additionally, a ratcheting lock ring 233 or similar single-directional locking mechanism could be engaged to the jack mandrel 210 to the jack body 226 at the same time to retain the cone assembly 202 in the extended position. The ratcheting lock ring 233 may include a cylindrical body split by a single longitudinal cut, and a fine buttress or sawtooth shaped thread on one of the inner or outer diameter of the cylindrical body and a coarse buttress or sawtooth shaped thread on the other of the inner or outer diameter. This split cylindrical body may be provided between the jack mandrel 210 to the jack body 226. The buttress or sawtooth shaped thread on the ratcheting lock ring 233 are oriented such that relative movement between the jack mandrel 210 to the jack body 226 is allowed in one direction (e.g., the jack mandrel 210 moving toward the left side as illustrated between FIGS. 3A and 3B), and such that the buttress or sawtooth shaped thread on the ratcheting lock ring 233 bind up with the jack mandrel 210 and the jack body 226 when relative movement between the jack mandrel 210 to the jack body 226 is in the other direction (e.g., the jack mandrel 210 moving toward the right side as illustrated between FIGS. 3B and 3A). While a ratcheting lock ring may be used to allow relative movement between the jack mandrel 210 to the jack body 226 in one direction and hinder relative movement between the jack mandrel 210 to the jack body 226 in the other direction, any other single-directional locking mechanism may be used, such as spring-loaded parts that are axially constrained within one body and include a sawtooth profile configured to engage an opposing sawtooth profile on the other body in order to lock up relative movement in one direction only, for example, a socket wrench.

Continued pumping of fluid through the jack mandrel 210 will apply pressure to expansion cup seals 110 (as explained above in reference to FIGS. 2A-2D) and move the cone assembly 202 through the tubular member 230, which causes radial expansion of the tubular member 230.

Figure 4:
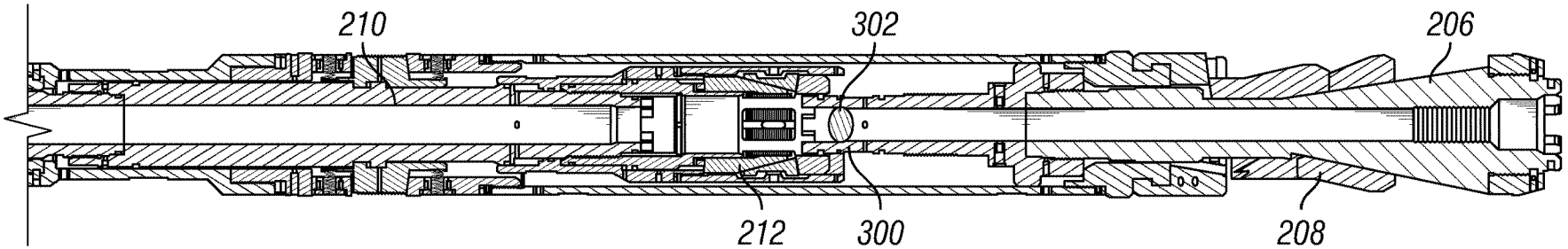
FIG. 4 illustrates one embodiment of an expansion cone being moved from an extended position to a retracted position.

Referring now to FIG. 4, tapered mandrel 206 may include a sealing shoulder 300 that is configured to engage a ball 302, or other sealing member, that can be pumped into position via jack mandrel 210. With ball 302 engaged with shoulder 300, continued supply of pressurized fluid to jack mandrel 210 will apply an axial load to the lower coupling 212. Once a predetermined axial load is achieved to shear pins, the lower coupling 212 will release, allowing the tapered mandrel 206 to move axially away from the jack mandrel 210. This axial movement allows the cone segments 208 to move along tapered mandrel 206 toward their collapsed position. This functionality may be especially beneficial should the cone assembly 202 becomes stuck in the tubular member (not shown) or to reduce the outer diameter of the cone assembly so as to simplify recovery following expansion operations.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. An expandable system comprising:

an expandable liner;

a cone assembly disposed within the expandable liner, wherein the cone assembly is moveable between a retracted position and an extended position, wherein in the extended position axial movement of the cone assembly through the expandable liner will radially expand the expandable liner;

a jack assembly disposed within the expandable liner and coupled to the cone assembly, wherein the jack assembly is operable to move the cone assembly from the retracted position to the extended position;

a latch assembly disposed within the expandable liner and coupled to the jack assembly and the cone assembly, wherein the latch assembly is operable to releasably couple the jack assembly and the cone assembly to the expandable liner; and a ratcheting lock ring disposed between a body and a mandrel of the jack assembly, wherein the jack assembly is operable to retain the cone assembly in the extended position.

2. The expandable system of claim 1, wherein the latch assembly comprises one or more latch dogs operable to move radially inward and disengage one or more corresponding receptacles formed on an inner surface of the expandable liner.

3. The expandable system of claim 2, further comprising expansion cup seals coupled to the jack assembly, wherein the expansion cup seals are operable to move the cone assembly set in the extended position through the expandable liner and cause radial expansion of the expandable liner.

4. The expandable system of claim 1, wherein the latch assembly is operable to release the jack assembly and the cone assembly from the expandable liner upon the cone assembly reaching the extended position.

5. The expandable system of claim 1, wherein the jack assembly comprises a release groove that registers with one or more latch dogs upon the cone assembly reaching the extended position, and wherein the one or more latch dogs are operable to move radially inward and engage the release groove upon the release groove registering with the one or more latch dogs.

6. The expandable system of claim 5, further comprising expansion cup seals coupled to the jack assembly, wherein the expansion cup seals are operable to move the cone assembly set in the extended position through the expandable liner and cause radial expansion of the expandable liner.

7. The expandable system of claim 1, wherein the jack assembly further comprises an upper coupling operable to lock the jack assembly until a fluid pumped into the expandable system reaches a predetermined pressure, wherein the latch assembly is operable to release the jack assembly and the cone assembly from the expandable liner upon the cone assembly reaching the extended position, and wherein the jack assembly is operable to prevent movement of the cone assembly upon the cone assembly reaching the extended position.

8. The expandable system of claim 7, wherein the latch assembly comprises one or more latch dogs operable to engage one or more corresponding receptacles formed on an inner surface of the expandable liner, wherein the jack assembly comprises a release groove that registers with the one or more latch dogs upon the cone assembly reaching the extended position, wherein the one or more latch dogs are operable to move radially inward, engage the release groove, and disengage the expandable liner upon the release groove registering with the one or more latch dogs, and wherein the upper coupling comprises a piston sleeve operable to move from a first position urging dogs toward the jack assembly and a second position permitting the dogs to move radially outward, and one or more pins configured to shear upon the fluid applying the predetermined pressure on the piston sleeve.

9. The expandable system of claim 8, further comprising expansion cup seals coupled to the jack assembly, wherein the expansion cup seals are operable to move the cone assembly set in the extended position through the expandable liner and cause radial expansion of the expandable liner.

10. An expandable system comprising:

an expandable liner;

a cone assembly disposed within the expandable liner, wherein the cone assembly is moveable between a retracted position and an extended position, wherein in the extended position axial movement of the cone assembly through the expandable liner will radially expand the expandable liner;

a jack assembly disposed within the expandable liner and coupled to the cone assembly, wherein the jack assembly is operable to move the cone assembly from the retracted position to the extended position; and a latch assembly disposed within the expandable liner and coupled to the jack assembly and the cone assembly, wherein the latch assembly is operable to releasably couple the jack assembly and the cone assembly to the expandable liner, wherein the latch assembly is operable to release the jack assembly and the cone assembly from the expandable liner upon the cone assembly reaching the extended position, wherein the latch assembly comprises one or more latch dogs operable to engage one or more corresponding receptacles formed on an inner surface of the expandable liner, wherein the jack assembly comprises a release groove that registers with the one or more latch dogs upon the cone assembly reaching the extended position, and wherein the one or more latch dogs are operable to move radially inward and disengage the expandable liner upon the release groove registering with the one or more latch dogs.

11. The expandable system of claim 10, further comprising expansion cup seals coupled to the jack assembly, wherein the expansion cup seals are operable to move the cone assembly set in the extended position through the expandable liner and cause radial expansion of the expandable liner.

12. The expandable system of claim 10, wherein the jack assembly is operable to retain the cone assembly in the extended position.

13. The expandable system of claim 12, wherein the jack assembly further comprises a ratcheting lock ring disposed between a body and a mandrel of the jack assembly.

14. The expandable system of claim 10, wherein the jack assembly further comprises an upper coupling operable to lock the jack assembly until a fluid pumped into the expandable system reaches a predetermined pressure.

15. An expandable system comprising:

an expandable liner;

a cone assembly disposed within the expandable liner, wherein the cone assembly is moveable between a retracted position and an extended position, wherein in the extended position axial movement of the cone assembly through the expandable liner will radially expand the expandable liner;

a jack assembly disposed within the expandable liner and coupled to the cone assembly, wherein the jack assembly is operable to move the cone assembly from the retracted position to the extended position; and a latch assembly disposed within the expandable liner and coupled to the jack assembly and the cone assembly, wherein the latch assembly is operable to releasably couple the jack assembly and the cone assembly to the expandable liner, wherein the jack assembly further comprises an upper coupling operable to lock the jack assembly until a fluid pumped into the expandable system reaches a predetermined pressure, wherein the upper coupling comprises a piston sleeve operable to move from a first position urging dogs toward the jack assembly and a second position permitting the dogs to move radially outward, and one or more pins configured to shear upon the fluid applying the predetermined pressure on the piston sleeve.

16. The expandable system of claim 15, wherein the latch assembly is operable to release the jack assembly and the cone assembly from the expandable liner upon the cone assembly reaching the extended position, and wherein the jack assembly is operable to prevent movement of the cone assembly upon the cone assembly reaching the extended position.

17. The expandable system of claim 16, wherein the latch assembly comprises one or more latch dogs operable to engage one or more corresponding receptacles formed on an inner surface of the expandable liner, wherein the jack assembly comprises a release groove that registers with the one or more latch dogs upon the cone assembly reaching the extended position, and wherein the one or more latch dogs are operable to move radially inward, engage the release groove, and disengage the expandable liner upon the release groove registering with the one or more latch dogs.

18. The expandable system of claim 17, further comprising expansion cup seals coupled to the jack assembly, wherein the expansion cup seals are operable to move the cone assembly set in the extended position through the expandable liner and cause radial expansion of the expandable liner.

19. The expandable system of claim 15, further comprising expansion cup seals coupled to the jack assembly, wherein the expansion cup seals are operable to move the cone assembly set in the extended position through the expandable liner and cause radial expansion of the expandable liner.

20. A method for expanding a liner comprising:

coupling an expansion tool to an expandable liner with a latch assembly, wherein the expansion tool includes a cone assembly, a jack assembly, and the latch assembly, and wherein the latch assembly comprises one or more latch dogs operable to engage one or more corresponding receptacles formed on an inner surface of the expandable liner to couple the expansion tool to the expandable liner;

disposing the expansion tool and expandable liner into a wellbore;

moving the cone assembly from a retracted position to an extended position using the jack assembly, wherein the latch assembly maintains the coupling between the expansion tool and the expandable liner while the cone assembly is moving from the retracted position to the extended position;

releasing the latch assembly so as to decouple the expansion tool from the expandable liner once the cone assembly is fully moved to the extended position, wherein the jack assembly comprises a release groove that registers with the one or more latch dogs upon the cone assembly reaching the extended position, and wherein the one or more latch dogs are operable to move radially inward and disengage the expandable liner and decouple the expansion tool from the expandable liner upon the release groove registering with the one or more latch dogs; and moving the cone assembly through the expandable liner without using the jack assembly, wherein moving the cone assembly radially expands the expandable liner.

21. The method of claim 20, further comprising retaining the cone assembly in the extended position once the cone assembly is fully moved to the extended position.

22. The method of claim 21, wherein the moving of the cone assembly through the expandable liner is performed by applying fluid pressure on expansion cup seals coupled to the jack assembly.

23. The method of claim 20, further comprising locking the jack assembly until a fluid pumped into the expansion tool reaches a predetermined pressure.

24. The method of claim 23, further comprising retaining the cone assembly in the extended position once the cone assembly is fully moved to the extended position.

25. The method of claim 24, wherein the moving of the cone assembly through the expandable liner is performed by applying fluid pressure on expansion cup seals coupled to the jack assembly.

* * * * *